US005921831A

United States Patent [19]

Schulze

[11] Patent Number: 5,921,831

[45] Date of Patent: Jul. 13, 1999

[54] AUXILIARY DEVICE FOR INFLATABLE LIFE RAFTS

[75] Inventor: Bernd Schulze, Neugersdorf, Germany

[73] Assignee: Deutsche Schlauchbootfabrik Hans Scheibert GmbH & Co, KG, Eschershausen, Germany

[21] Appl. No.: 08/962,411

[22] Filed: Oct. 31, 1997

[30] Foreign Application Priority Data

Nov. 2, 1996 [DE] Germany ..... 196 45 205

[51] Int. Cl.[6] ..... B63B 35/58

[52] U.S. Cl. ..... 441/38; 114/360; 441/40

[58] Field of Search ..... 441/37, 38, 40; 114/360, 349, 345

[56] References Cited

U.S. PATENT DOCUMENTS 3,054,124 9/1962 Silverstone ..... 441/38
3,995,339 12/1976 Kaufman ..... 441/40
4,533,333 8/1985 Andrew et al. ..... 441/38
4,998,900 3/1991 Wright ..... 441/38

*Primary Examiner*—Sherman Basinger
*Attorney, Agent, or Firm*—Robert W. Bcker & Associates

[57] ABSTRACT

An auxiliary device for an inflatable life raft, wherein the life raft has a flotation body, including at least one support tube and a bottom and further having a roof structure, including an inflatable support and a cover, has at least one bracket positioned exterior to the roof structure and spanning the roof structure. The at least one bracket includes a closed, inflatable hollow body and a pressure medium connector for inflating the closed inflatable hollow body with a pressure medium. Fasteners connected to the at least one bracket are provided for connecting the at least one bracket to the life raft.

13 Claims, 1 Drawing Sheet

AUXILIARY DEVICE FOR INFLATABLE LIFE RAFTS

BACKGROUND OF THE INVENTION

The present invention relates to an auxiliary device for inflatable life rafts having an annular, inflatable flotation body and a roof structure with inflatable supports.

Life rafts of this kind have the disadvantage that, once they are in an upside down position in the water, it is very difficult, or not possible at all, to return them into the required upright position of use. For this reason, it has been suggested in the past to provide life rafts with brackets that span the roof structure and are inflatable in order to produce a self-righting action of the life raft in the case that the life raft is in the undesirable upside down position. These brackets are already incorporated into the life rafts during manufacture. They are therefore a fixed component of the life raft when the life raft is sent off by the manufacturer.

It is an object of the present invention to provide an auxiliary device for the aforementioned life rafts, that are difficult to be flipped over into the upright position because they are not provided with the aforementioned brackets by the manufacturer, so that the life rafts can be retrofitted with the auxiliary device for providing a self-righting action to the life raft.

SUMMARY OF THE INVENTION

An auxiliary device for an inflatable life raft, wherein the life raft comprises a flotation body, having at least one support tube and a bottom, and further comprises a roof structure, including an inflatable support and a cover, the auxiliary device according to the present invention is primarily characterized by:

At least one bracket positioned exterior to the roof structure and spanning the roof structure;

The at least one bracket comprising a closed, inflatable hollow body and a pressure medium connector for inflating the closed, inflatable hollow body with a pressure medium;

Fasteners connected to the at least one bracket for connecting the at least one bracket to the life raft.

Advantageously, the at least one bracket has a first and a second lower ends, wherein the lower ends are vertically downwardly extending members and wherein the fasteners are connected to the vertically downwardly extending members.

The auxiliary device advantageously further comprises a separate pressure medium source connected to the pressure medium connector for inflating the closed, inflatable hollow body.

The pressure medium connector is preferably connected to a pressure medium source for inflating the flotation body.

The pressure medium connector may be connected to a pressure medium source for inflating the upper support tube of the flotation body.

The pressure medium connector is preferably designed such that the at least one bracket inflates at least as quickly as the flotation body or at least as quickly as the upper support tube of the flotation body.

Inflation of the at least one bracket and of the flotation body or of the at least one bracket and of the upper support tube of the flotation body is preferably time-controlled and/or controlled by supply lines having different diameters.

Expediently, the fasteners include eyes for tying the at least one bracket to the life raft.

The life raft preferably also has eyes for tying the at least one bracket to the life raft.

The at least one bracket has a first and a second lower ends and the fasteners include transverse members connected to the lower ends, wherein the transverse members project laterally past the lower ends and match an outer contour of the flotation body at the location of attachment of the at least one bracket.

The auxiliary device may further include guy ropes for connecting the flotation body and the at least one bracket.

The at least one bracket extends parallel to support struts of the roof structure.

According to the present invention, inflatable brackets are provided that span the roof structure and have in the area of their lower legs fasteners for fastening the brackets to the flotation body. They are furthermore provided with their own pressure medium connector especially for an independent pressure medium (inflation medium) source or for a branch of the pressure medium supply line that is guided to the flotation body.

The fasteners can be in the form of clamps, tie-down devices, zippers and optionally also in the form of self-adhering fusing components or adhesives. All of these means, however, must be able to attach the ends of the brackets sufficiently securely and in a retro-fitting manner to the flotation body.

Preferably, the pressure medium connectors are designed such that the inflation of the brackets of the auxiliary device is performed before inflation of the flotation body, or at least simultaneously thereto, in order to ensure that with a timely, respectively, early inflation of the additional brackets the righting effect for the flotation body will occur.

The fasteners for fastening the aforementioned ends of the brackets can also be in the form of clamps which ensure a positive-locking connection to the flotation body. It is also possible to provide guy ropes in order to prevent a folding of the brackets.

BRIEF DESCRIPTION OF THE DRAWINGS

The object and advantages of the present invention will appear more clearly from the following specification in conjunction with the accompanying drawings, showing in:

Figure 1:
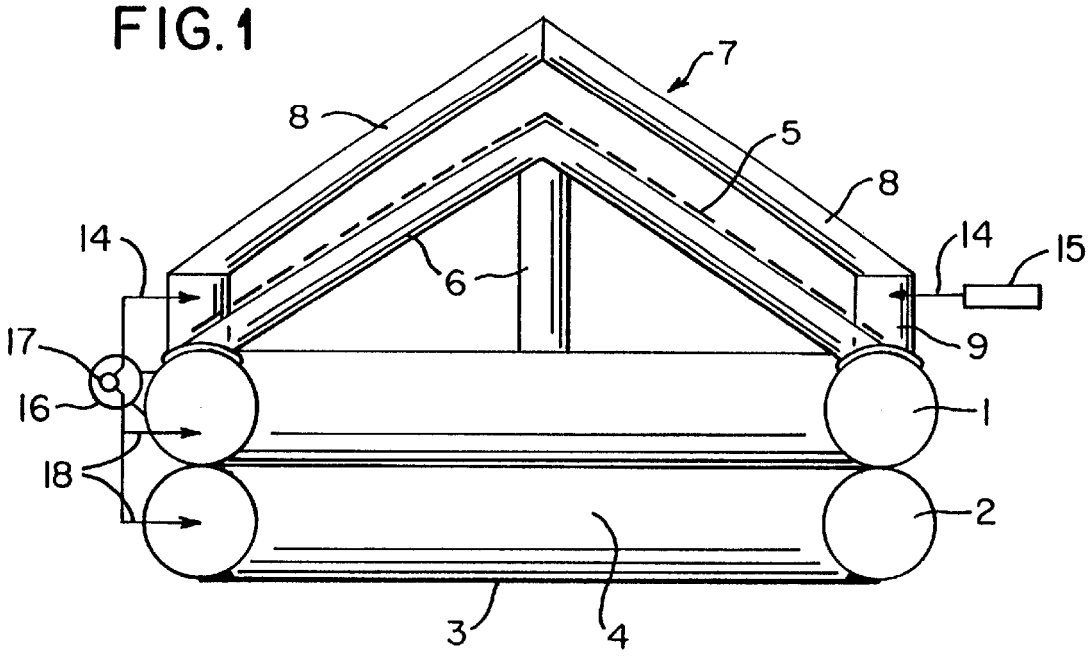
Figure 2:
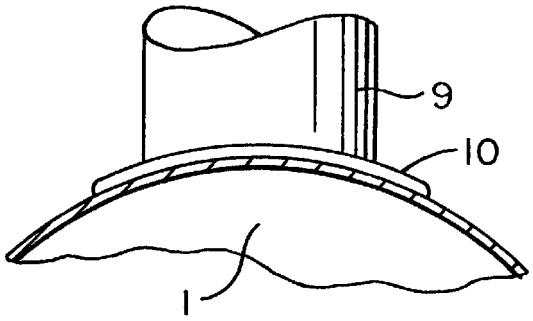
Figure 3:
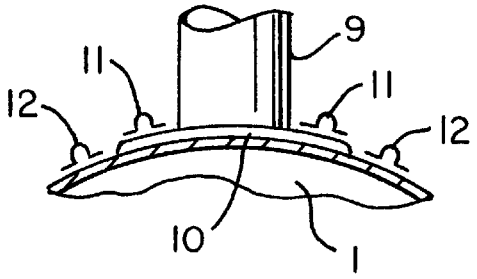
Figure 4:
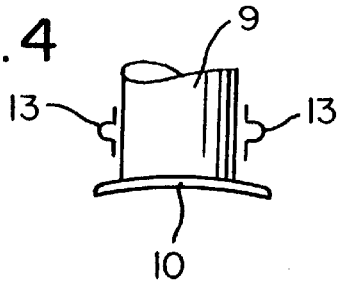

| | |
|---|---|
| FIG. 1 | a vertical section of a life raft with mounted auxiliary device; |
| FIG. 2 | a section of the upper part of a flotation body of a life raft in the area of attachment of the auxiliary device; |
| FIG. 3 | a section of the upper part of a flotation body of a life raft in the area of attachment of the auxiliary device in a different embodiment; |
| FIG. 4 | the lower end of the bracket of the auxiliary device in a side view. |

DESCRIPTION OF PREFERRED EMBODIMENTS

The present invention will now be described in detail with the aid of several specific embodiments utilizing FIGS. 1 through 4.

The flotation body of the life raft is comprised of two support tubes 1, 2 that in plan view can be angular (polygonal) or, in general, circular. The bottom is shown at reference numeral 3. The space 4 for receiving shipwrecked persons is covered by a roof that is comprised of a cover 5 and a roof support comprised of tubes 6.

Such life rafts have the disadvantage that, when used in emergencies, they can be flipped over (righted) from an upside down position only with difficulty because they exhibit a suction effect relative to the water surface when they rest on the water while not yet inflated. This state including the suction effect, is not changed even when the flotation body becomes inflated.

In order to overcome this disadvantage, two parallel brackets 7, that cross one another and span the roof structure, are provided which are comprised of flexible material, for example, a coated fabric, as are the parts 1, 2, 5, and 6. These brackets are hollow bodies that are inflatable in order to form shape-stable arches. These brackets 7 are comprised of two legs 8 which, above the top of the roof, connect at an angle to one another and which are connected to the flotation body by their lower ends having vertically extending members 9.

In order to attach the brackets 7 for retro-fitting a life raft, the vertical members 9 have transverse members 10 connected thereto which, according to FIG. 2, are connected to the flotation body, respectively, the support tube 1 by a self-adhesive action or by welding or fusing. However, other types of fasteners, for example, eyes 11 connected to the transverse member 10 and used for tying together the brackets and flotation body in cooperation with eyes 12 provided at the support tube 1. Also, eyes 13 can be provided at the vertical member 9 which are also used for tying the brackets to the flotation body.

It is furthermore important that the brackets 7 have an independent pressure medium connector 14 that is separate from the pressure supply to the flotation body. The pressure medium connector 14 can be connected to its own separate pressure medium source (bottle 15) shown at the right half of the life raft in FIG. 1, or can be supplied by the pressure medium source 16 via a Y-member 17 (distributor). This source 16 also supplies the two support tubes 1, 2 or only the upper support tube 1 (see left half of drawing FIG. 1). The pressure medium connectors of the two support tubes 1, 2 are shown at reference numeral 18. Preferably, the inflation should take place such that the pressure medium connector 14 can fill the brackets 7 at least as quickly preferably even faster, than flotation body. This can be achieved by time control and/or a respective dimensioning of the supply lines, for example, by providing throttles, valves etc.

The aforedescribed measures allow the retro-fitting of already produced or already distributed (purchased) life rafts.

The present invention is, of course, in no way restricted to the specific disclosure of the specification and drawings, but also encompasses any modifications within the scope of the appended claims.

What is claimed is:

1. An auxiliary device for an inflatable life raft, wherein said life raft comprises a flotation body, having at least one support tube and a bottom, and further comprises a roof structure, including an inflatable support and a cover, said auxiliary device comprising:

at least one bracket positioned exterior to the roof structure and spanning the roof structure;

said at least one bracket comprising a closed, inflatable hollow body and a pressure medium connector for inflating said closed, inflatable hollow body with a pressure medium;

fasteners connected to said at least one bracket for connecting said at least one bracket to the life raft;

wherein said pressure medium connector is designed such that said at least one bracket inflates at least as quickly as the flotation body or at least as quickly as an upper support tube of the flotation body;

wherein inflation of said at least one bracket and of the flotation body or of said at least one bracket and of the upper support tube of the flotation body is controlled by supply lines having different diameters.

2. An auxiliary device according to claim 1, wherein said at least one bracket has a first and a second lower ends, wherein said lower ends are vertically downwardly extending members, and wherein said fasteners are connected to said vertically downwardly extending members.

3. An auxiliary device according to claim 1, further comprising a separate pressure medium source connected to said pressure medium connector for inflating said closed, inflatable hollow body.

4. An auxiliary device according to claim 1, wherein said pressure medium connector is connected to a pressure medium source for inflating the flotation body.

5. An auxiliary device according to claim 1, wherein said pressure medium connector is connected to a pressure medium source for inflating an upper support tube of the flotation body.

6. An auxiliary device according to claim 1, wherein inflation of said at least one bracket and the flotation body or of said at least one bracket and an upper support tube of the flotation body is time-controlled.

7. An auxiliary device according to claim 1, wherein said at least one bracket has lower ends and wherein said fasteners include transverse members connected to said lower ends, wherein said transverse members project laterally past said lower ends and match an outer contour of the flotation body at a location of attachment of said at least one bracket.

8. An auxiliary device according to claim 1, wherein said at least one bracket extends parallel to support struts of the roof structure.

9. An auxiliary device for an inflatable life raft, wherein said life raft comprises a flotation body, having at least one support tube and a bottom, and further comprises a roof structure, including an inflatable support and a cover, said auxiliary device comprising:

at least one bracket positioned exterior to the roof structure and spanning the roof structure;

said at least one bracket comprising a closed, inflatable hollow body and a pressure medium connector for inflating said closed, inflatable hollow body with a pressure medium;

fasteners connected to said at least one bracket for connecting said at least one bracket to the life raft;

wherein said pressure medium connector is designed such that said at least one bracket inflates at least as quickly as the flotation body or at least as quickly as an upper support tube of the flotation body:

wherein inflation of said at least one bracket and of the flotation body or of said at least one bracket and of the upper support tube of the flotation body is time controlled and controlled by supply lines of different diameter.

10. An auxiliary device for an inflatable life raft, wherein said life raft comprises a flotation body, having at least one support tube and a bottom, and further comprises a roof structure, including an inflatable support and a cover, said auxiliary device comprising:

at least one bracket positioned exterior to the roof structure and spanning the roof structure;

said at least one bracket comprising a closed, inflatable hollow body and a pressure medium connector for inflating said closed, inflatable hollow body with a pressure medium;

fasteners connected to said at least one bracket for connecting said at least one bracket to the life raft;

wherein said fasteners include eyes for tying said at least one bracket to the life raft.

11. An auxiliary device according to claim 10, wherein said pressure medium connector is designed such that said at least one bracket inflates at least as quickly as the flotation body or at least as quickly as an upper support tube of the flotation body.

12. An auxiliary device according to claim 11, wherein inflation of said at least one bracket and of the flotation body or of said at least one bracket and of the upper support tube of the flotation body is controlled by supply lines having different diameters.

13. An auxiliary device according to claim 10, wherein the life raft has eyes for tying said at least one bracket to the life raft.

* * * * *